US008056837B2

(12) United States Patent
Gardner et al.

(10) Patent No.: US 8,056,837 B2
(45) Date of Patent: Nov. 15, 2011

(54) NOZZLE FOR USE WITH A PRESSURE WASHER

(75) Inventors: Michael R. Gardner, Anderson, SC (US); Klaus K. Hahn, Braselton, GA (US); Jesse J. Jerabek, Anderson, SC (US)

(73) Assignee: Techtronic Outdoor Products Technology Limited, Hamilton (BM)

( * ) Notice: Subject to any disclaimer, the term of this patent is extended or adjusted under 35 U.S.C. 154(b) by 211 days.

(21) Appl. No.: 12/429,357

(22) Filed: Apr. 24, 2009

(65) Prior Publication Data

US 2009/0266923 A1 Oct. 29, 2009

Related U.S. Application Data

(60) Provisional application No. 61/047,912, filed on Apr. 25, 2008.

(51) Int. Cl.
*B05B 1/26* (2006.01)

(52) U.S. Cl. ..... 239/601; 239/124; 239/493; 239/496; 239/504; 239/589; 239/597; 239/722

(58) Field of Classification Search ..... 239/124, 239/504, 548, 568, 589, 597, 601, 722, 493, 239/494, 496

See application file for complete search history.

(56) References Cited

U.S. PATENT DOCUMENTS

| | | | | |
|---|---|---|---|---|
| 587,344 | A | 8/1897 | Tinsley | |
| 617,472 | A | 1/1899 | Neumeyer et al. | |
| 2,676,062 | A | 4/1954 | Hamilton | |
| 2,801,882 | A | 8/1957 | Schwemlein | |
| 2,985,386 | A | 5/1961 | Steinen | |
| 3,401,888 | A * | 9/1968 | Sutter | 239/568 |
| 3,716,194 | A | 2/1973 | Miller | |
| 4,102,501 | A | 7/1978 | De Gelder et al. | |
| 4,646,977 | A | 3/1987 | Iwamura et al. | |
| 7,380,732 | B2 * | 6/2008 | Bolman et al. | 239/601 |
| 2005/0205695 | A1 * | 9/2005 | Geskin et al. | 239/589 |
| 2006/0108449 | A1 * | 5/2006 | Sodemann et al. | 239/124 |
| 2006/0147641 | A1 | 7/2006 | Nissinen et al. | |
| 2009/0065612 | A1 | 3/2009 | Gardner et al. | |

FOREIGN PATENT DOCUMENTS

| | | | |
|---|---|---|---|
| EP | 1554049 | B1 | 11/2006 |
| JP | 57059653 | A2 | 4/1982 |
| JP | 113000237 | A | 11/1999 |
| WO | 8301186 | A1 | 4/1983 |

* cited by examiner

*Primary Examiner* — Steven J Ganey
(74) *Attorney, Agent, or Firm* — Michael Best & Friedrich LLP

(57) ABSTRACT

A nozzle for use with a pressure washer, and the nozzle includes a body portion that defines a longitudinal axis and a head portion coupled to the body portion and in fluid communication with the body portion. The head portion includes a face substantially perpendicular to a longitudinal axis of the body portion. An elongated first slot is disposed upon the face of the head portion, and an elongated second slot is disposed upon the face of the head portion and in a nonparallel orientation with respect to the first slot. A fluid outlet aperture extends through the face and is at least partially located within at least one of the first and second slots to allow a fluid flow from within the body portion to exit the nozzle from the head portion.

28 Claims, 8 Drawing Sheets

NOZZLE FOR USE WITH A PRESSURE WASHER

CROSS-REFERENCE TO RELATED APPLICATIONS

This application claims priority to U.S. Provisional Patent Application No. 61/047,912, filed Apr. 25, 2008, the entire contents of which are hereby incorporated by reference herein.

BACKGROUND

Pressure washers are often used to provide a substantially constant flow of fluid at an increased pressure to a work surface or object for cleaning of that surface or object. Pressure washers often include a pump for increasing the pressure of fluid provided therefrom, a path for fluid flowing from the pump discharge, and a wand or similar output device that can be held by the user to direct the relatively high pressure flow to the object or surface to be cleaned. A nozzle is often attached to the output device that includes a wand. Some nozzles provide output flow in a single cylindrical stream, multiple parallel streams, or planar fluid flows.

SUMMARY

In one embodiment the invention provides a nozzle for use with a pressure washer having an output device to direct a fluid flow. The nozzle includes a body portion that defines a longitudinal axis, and the body portion is configured to be fluidly coupled with the output device of the pressure washer to receive the fluid flow. The nozzle further includes a head portion coupled to the body portion and in fluid communication with the body portion. The head portion includes a face substantially perpendicular to the longitudinal axis of the body portion. An elongated first slot is disposed upon the face of the head portion, and an elongated second slot is disposed upon the face of the head portion and in a nonparallel orientation with respect to the first slot. A fluid outlet aperture extends through the face and is at least partially located within at least one of the first and second slots to allow the fluid flow from within the body portion to exit the nozzle from the head portion.

In another embodiment the invention provides a pressure washer system that includes an inlet connection configured to receive a flow of fluid from a fluid supply and a pump having an outlet. The pump is configured to receive the flow of fluid and provide an output flow through the outlet. An output device is in fluid communication with the outlet of the pump to receive the output flow. A nozzle is coupled to the output device to receive the output flow. The nozzle includes first and second elongated slots that together emit a spray pattern having first and second substantially planar nonparallel fluid flows.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
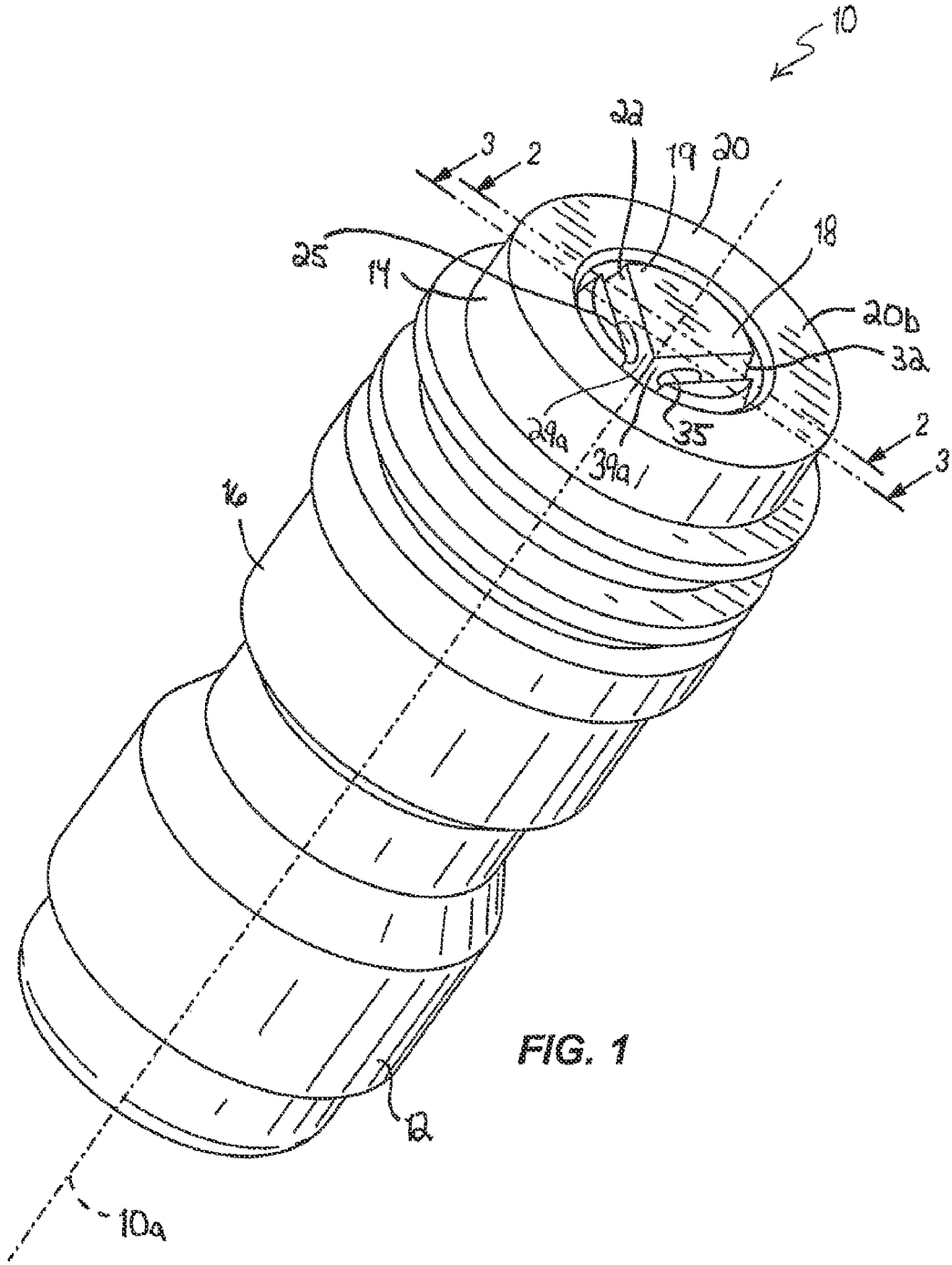
FIG. 1 is a perspective view of a nozzle according to one construction of the invention.
Figure 2:
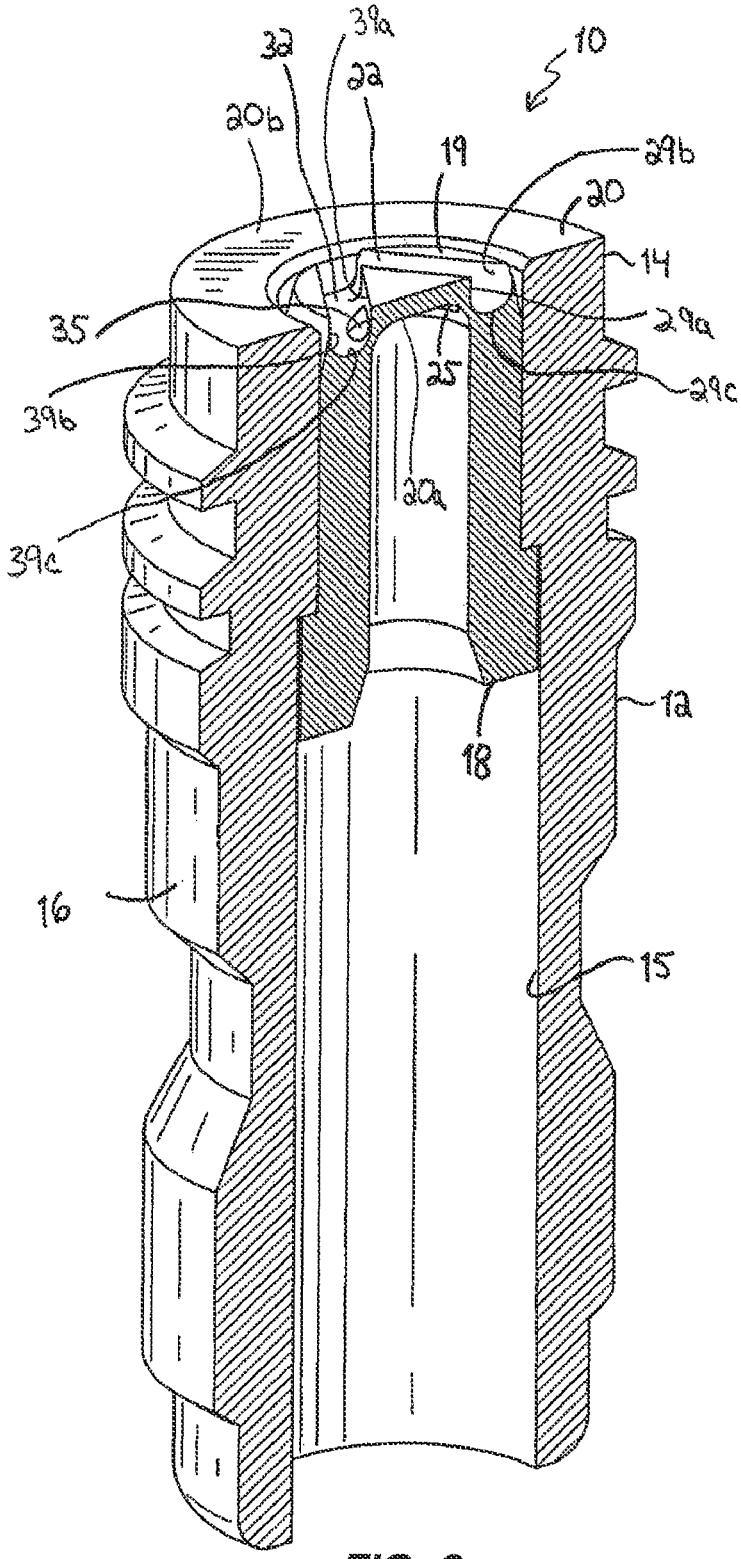
FIG. 2 is a perspective cross-sectional view of the nozzle of FIG. 1 taken along line 2-2 of FIG. 1.
Figure 3:
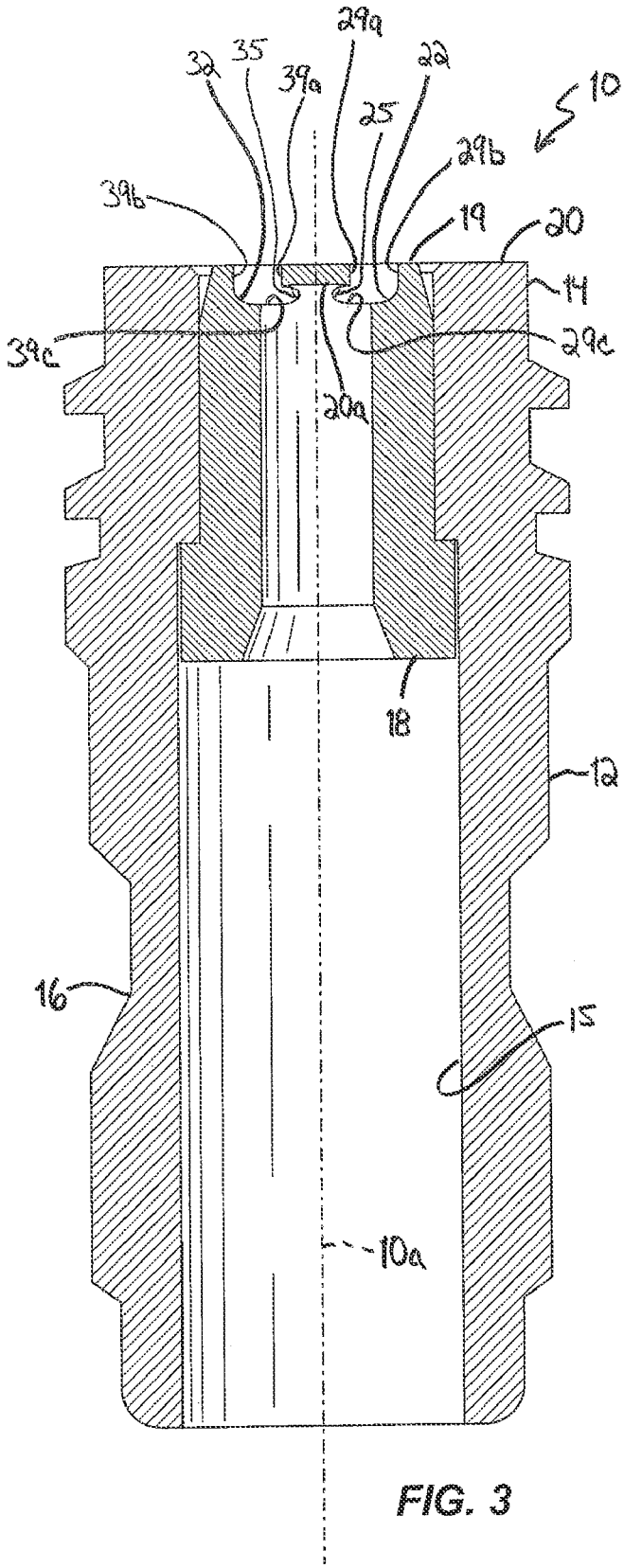
FIG. 3 is a side cross-sectional view of the nozzle of FIG. 1 taken along line 3-3 of FIG. 1.
Figure 4:
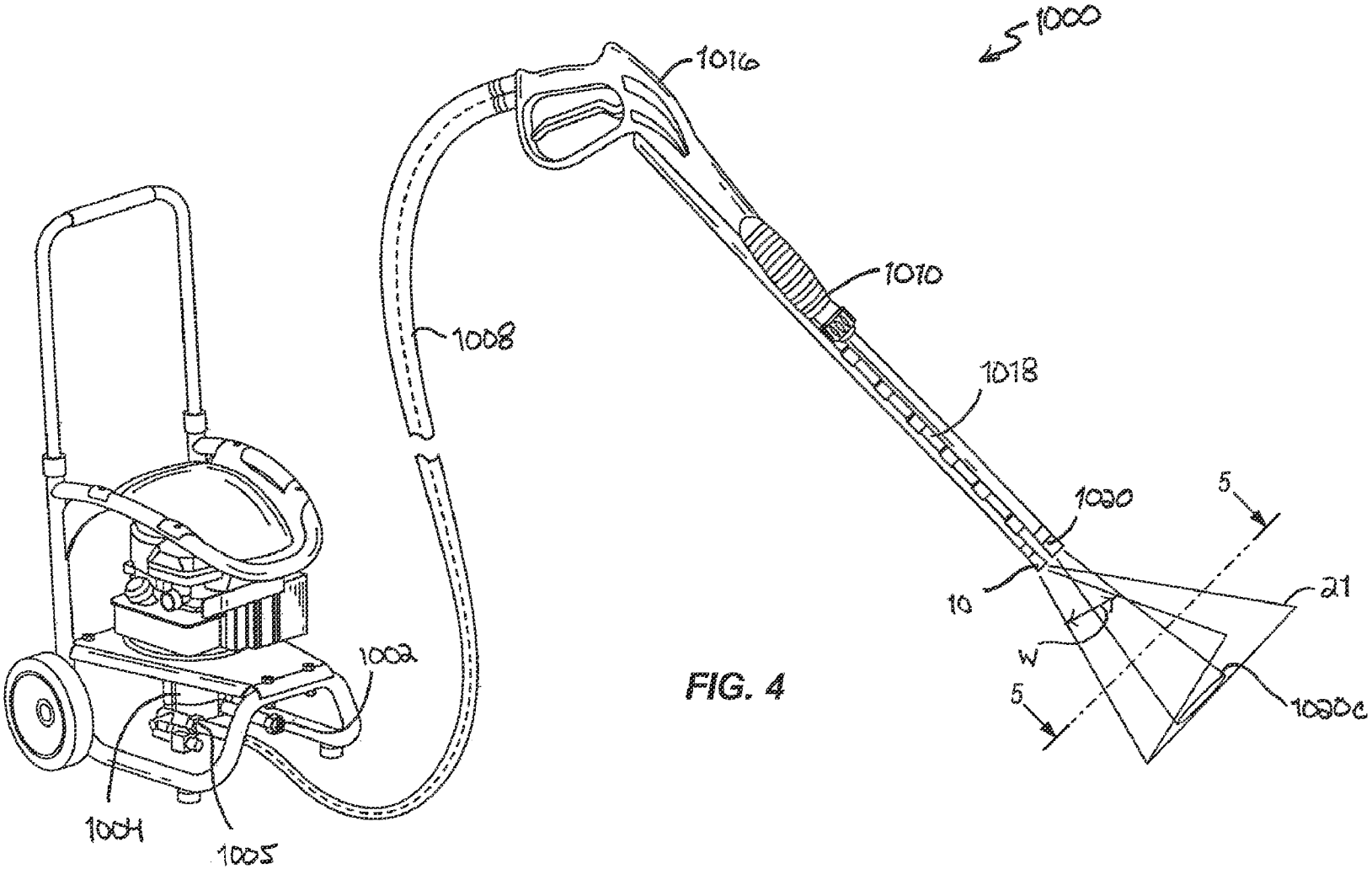
FIG. 4 is a perspective view of a pressure washer system that includes the nozzle of FIG. 1.

FIG. 1 illustrates a nozzle 10 for use with a pressure washer 1000 (FIG. 4). The illustrated nozzle 10 is coupled to a wand 1018 of the pressure washer 1000 to produce a spray pattern 21 from the wand 1018 and pressure washer 1000. Referring to FIGS. 1-3, the nozzle 10 includes a body portion 12, a head portion 14, and a cavity 15 that extends through the body portion 12 to allow fluid communication between the body portion 12 and the head portion 14. The body portion 12 of the nozzle 10 is configured as a male insertion member that is configured to be received within a conventional female quick connect coupler. In other constructions, the body portion 12 may include male screw threads that are configured to mate with corresponding female threads on a wand, lance, or other output device of a pressure washer. In yet other constructions, the body portion 12 may include any suitable female end (i.e., quick connect, threaded, or the like) that is configured to mate with a suitable male member to receive a fluid flow from the male member. In still other constructions, one of the body 12 or the receiving structure may include a female jam nut that seals with a correspondingly flat surface with one or more o-rings or other sealing structures therebetween.

Figure 5:
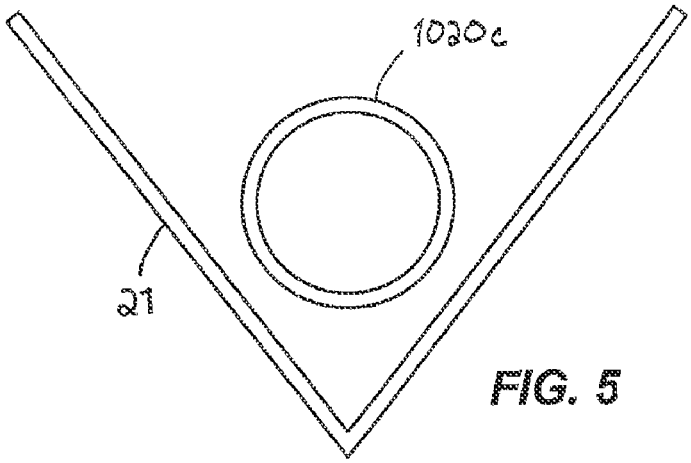
FIG. 5 is a schematic representation of a flow profile from the pressure washer of FIG. 4 taken along line 5-5 of FIG. 4.

The illustrated nozzle 10 is formed from an outer shell 16 that defines an outer cylindrical surface of the nozzle 10 and an inner plug 18 that is disposed within the outer shell 16. An end face of the inner plug 18 forms a portion 19 of a face 20 of the nozzle 10. The nozzle 10 is configured to be removeably coupled to a lance, wand or other output device (for example, the wand 1018 of FIG. 4) that is in fluid communication with the pressure washer 1000 (FIG. 4) or another source of fluid, such as a garden hose that receives flow from a municipal water source or other remote water source. The nozzle 10 receives a flow of fluid into the body portion 12 from the wand, lance, or other structure connected therewith, and provides an output flow through the face 20 of the nozzle 10 in a V-shaped spray pattern 21, as shown schematically in FIGS. 4-5. In the illustrated construction, the flow of fluid into the body portion 12 of the nozzle 10 is a constant flow of fluid, and in other constructions, the flow of fluid can be a pulsating flow of fluid. The nozzle 10 is configured to receive fluid at a relatively low pressure, (i.e., a pressure substantially the same as fluid received from a municipal or remote water source, and for example between about 40 and 100 psi) or at a relatively high pressure (e.g., a pressure between about 500 psi and 3500 psi, or between about 500 psi and about 6000 psi) when the nozzle 10 is connected downstream of an operating pressure washer.

The face 20 of the nozzle 10 is defined by an end face of the nozzle head portion 14 of the nozzle 10 and the end face of the plug 18. In the illustrated construction, the face 20 is oriented substantially perpendicular to a longitudinal axis 10*a* of the nozzle 10. The longitudinal axis 10*a* extends through the body portion 12 and the head portion 14 of the nozzle 10. As shown in FIG. 2, the face 20 includes an inner surface 20*a* that is directed toward the body portion 12 of the nozzle 10 (i.e., into the cavity 15) and an opposite outer surface 20*b* that is directed away from the body 12.

The face 20 includes a first elongated slot 22 and a second elongated slot 32 that are both formed in the face 20. The first elongated slot 22 includes a first fluid outlet aperture or port 25 and the second elongated slot 32 includes a second fluid outlet aperture or port 35. The outlet apertures 25 and 35 allow fluid communication from the cavity 15 through the face 20 and out of the nozzle 10. In the construction with the nozzle 10 formed from the outer shell 16 and the inner plug 18, the first and second slots 22 and 32 are each formed upon the inner plug 18. As shown in FIGS. 1-3, the first and second slots 22 and 32 are defined upon the outer surface 20*b* of the face 20. In other embodiments, such as the embodiment of FIGS. 8-9, which is discussed in more detail below, the first and second slots 22 and 32 are formed on the inner surface 20*a* of the face 20.

Figure 6:
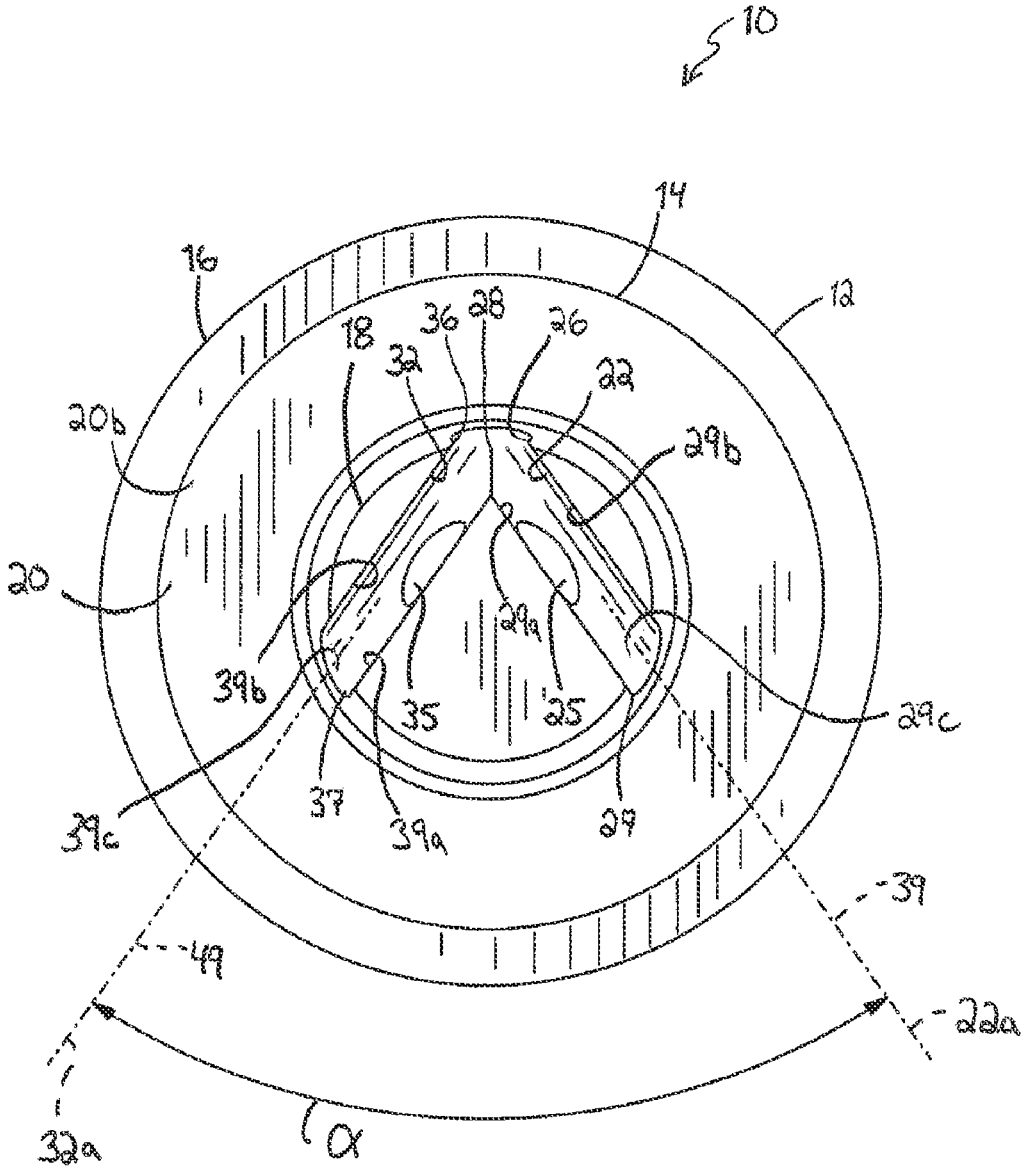
FIG. 6 is a top view of the nozzle of FIG. 1.

Referring to FIG. 6, each of the first and second slots 22, 32 include respective first ends 26 and 36 and respective, opposite second ends 27 and 37. The first ends 26 and 36 are disposed at generally the same position on the face 20 in an intersecting manner. The first slot 22 defines a longitudinal axis 39 and the second slot 32 defines a longitudinal axis 49. The axes 39, 49 intersect at a vertex 28 and define an included angle $\alpha$ between the axes 39, 49 such that the slots 22, 32 are disposed upon the face 20 in a nonparallel orientation with respect to each other. In the illustrated embodiment the angle $\alpha$ is approximately 70 degrees. In other constructions, the angle $\alpha$ may be between about 0.1 degrees and 179.9 degrees (e.g., nonparallel orientation). In other constructions, the angle $\alpha$ may be between about 30 degrees and about 120 degrees. In yet other constructions the angle $\alpha$ may be between about 45 degrees and about 75 degrees. In still other constructions the angle $\alpha$ may be between about 60 and 70 degrees and in one construction about 67 degrees. The angle $\alpha$ can be yet other specific angles within any of the ranges of angles $\alpha$ listed above.

Figure 7:
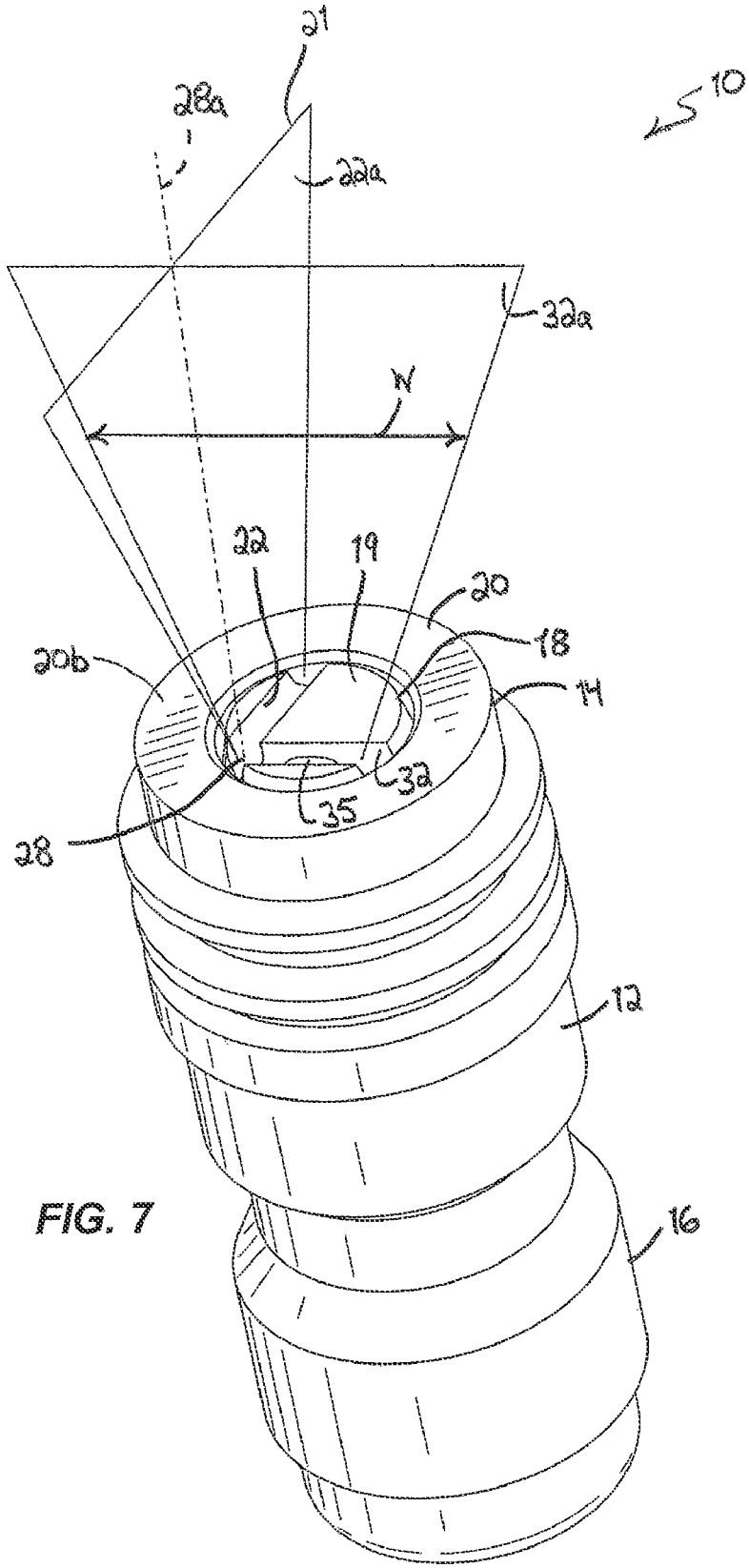
FIG. 7 is another perspective view of the nozzle of FIG. 1.

Referring to FIGS. 3, 6, and 7, the slots 22, 32 and the respective apertures 25, 35 are configured such that a portion of the fluid flows directly from the respective aperture 25, 35 out of the nozzle 10, and therefore exits the nozzle 10 substantially parallel to the longitudinal axis 10*a* of the nozzle 10. Another portion of the fluid flowing through the apertures 25, 35 flows through a portion of the length of the respective slot 22, 32 prior to leaving the front face 20 and ultimately leaves the nozzle 10 from a different location than the aperture. The fluid leaves the nozzle 10 along two planes 22*a* and 32*a*, each of which extends generally along the length or longitudinal axis 39, 49 of the respective slot 22, 32 and perpendicular to the face 20 of the nozzle 10. As best shown schematically in FIGS. 4, 5 and 7, the fluid leaving the face 20 of the nozzle 10 accordingly forms the V-shaped spray pattern 21, with two substantially planar flows generally along the planes 22*a*, 32*a*. The planes 22*a*, 32*a* initially intersect near the vertex 28 of the slots 22, 32 and continue to intersect along a line or second vertex 28*a*. The fluid leaves the nozzle 10 along the planes 22*a*, 32*a* that linearly expand in a width W (i.e., distance across the plane parallel to the face 20). The width W expands or increases along a length of the planes 22*a*, 32*a* or as the fluid travels away from the face 20 of the nozzle 10, as illustrated in FIG. 7. Accordingly, as the fluid flow travels away from the nozzle 10 (and toward the surface to be cleaned) the spray pattern may change from a substantially V-shaped spray pattern 21 to a substantially X-shaped spray pattern.

As best seen in FIGS. 3 and 6, the first and second slots 22, 32 are each formed with opposed inner flat portions 29*a*, 39*a* and outer flat portions 29*b*, 39*b*. Curved portions 29*c*, 39*c* of the first and second slots 22, 32, respectively, connect the inner flat portions 29*a*, 39*a* with the opposed outer flat portions 39*a*, 39*b*, of the respective slot 22, 32 (FIGS. 2 and 3). The first and second slots 22, 32 are each formed with a uniform cross-section along the respective length. In other constructions, the cross-section of each of the slots may vary along the respective length. Also, in the illustrated construction, the geometry of the cross-section of each of the slots 22, 32 is uniform on both sides of the slot 22, 32 when bisected by the respective central plane 22*a*, 32*a*. In other constructions, the geometry of the cross-section of the slots on either side of the plane 22*a*, 32*a* can vary. The outlet apertures 25, 35 are each disposed within the respective slot 22, 32 such that fluid flows through the aperture 25, 35 and then away from the front face 20 and the nozzle 10.

Referring to FIG. 2, in the illustrated construction, the aperture 35 within the second slot 32 extends through only a portion of the length of the second slot 32, and the aperture 35 extends through the curved portion 39*c* of the slot 32. The aperture 25 of the first slot 22 is similarly disposed within the first slot 22. As best seen in FIG. 6, each of the apertures 25, 35 also extend through only a portion of the respective curved portion 29*c*, 39*c* and the apertures 25, 35 are positioned between the respective plane 22*a*, 32*a* and the respective flat portion 29*a*, 39*a*. In other constructions, each of the apertures 25, 35 may extend through an alternate portion of the cross-section of the respective slot 22, 32 and the location of the apertures 25, 35 may vary along the length of the respective slot 22, 32.

The location and geometry of the apertures 25, 35 (and the location upon the respective slots 22, 32) may be altered to modify the geometry of the fluid flow leaving the first and second slots 22, 32 and the face 20 of the nozzle 10. Further, the location and geometry of the slots 22, 32 (including the location and geometry of the respective apertures 25, 35) may be altered to provide a suitable V-shaped spray pattern from the nozzle 10 when the nozzle 10 receives fluid with varied fluid pressures.

As shown in FIG. 4, the nozzle 10 may be used with the pressure washer system 1000. The pressure washer system 1000 includes an input connection 1002 for receiving a continuous input flow of fluid, a pump 1004 having an outlet 1005 that increases the fluid pressure of at least a portion of the fluid flowing through the input connection 1002, and an output device 1010 fluidly connected with the discharge of the pump 1004 and/or the input connection 1002. In the illustrated construction, the output device 1010 includes a spray gun 1016 and wand 1018. Also in the illustrated construction, the output device 1010 is configured to receive fluid flow only from the discharge of the pump 1004. The output device 1010 is connected to the pump outlet 1005 with a hose 1008 that provides for a two-part parallel flow therethrough. In other constructions, the output device 1010 may be configured to receive one flow from the discharge of the pump 1004 and another flow from the input connection 1002 (i.e., a connection directly between the input connection 1002 and the output device 1010, thereby bypassing the pump 1004). In yet other constructions, the output device may be connected to one or both of the pump outlet 1005 and the input connection 1002 to provide a single flow rather than the two-part hose 1008 for parallel flow illustrated in FIG. 4.

The illustrated output device 1010 includes a first output flow from the nozzle 10, which is a first nozzle, and a second output flow from a second nozzle 1020. Several embodiments of pressure washers with multiple output flows through neighboring nozzles are disclosed in U.S. Published Application No. 2007/0125878, filed on Oct. 24, 2006 and published on Jun. 7, 2007, the entire contents of which is fully incorporated by reference herein. The nozzle 1020 may be a nozzle with a zero degree pencil spray, a turbo or oscillating spray flow, a fan spray flow, or other flow patterns known in the art. The output device 1010 is arranged such that the substantially V-shaped spray pattern produced by the first nozzle 10 surrounds the flow 1020*c* produced by the second nozzle 1020, as shown schematically in FIGS. 4 and 5. In the illustrated construction, both nozzles 10, 1020 receive relatively high pressure flows from the pump 1004. In other constructions, the second nozzle 1020 receives and propels relatively high pressure flow ultimately received from the discharge of the pump 1004, and the first nozzle 10 receives and propels flow ultimately received from the input connection 1002 and bypassing the pump 1004. In such a construction, the high pressure flow (but relatively low volume) from the second nozzle 1020 is used to mechanically agitate the dirt from the surface to be cleaned, with the lower pressure (but high volume) flow from the first nozzle 10 used to flush the removed dirt from the area.

The combined use of the first and second nozzles 10, 1020 from the output device 1010 allows a relatively large surface to be cleaned and then flushed regardless of the orientation of the nozzles 10, 1020 (by way of the output device) with respect to the surface to be cleaned. In other words, the V-shaped spray pattern 21 from the first nozzle 10 cleans and flushes a relatively large surface area regardless of whether the spray is oriented horizontally or vertically, and regardless of what direction a user moves the spray flow (i.e. up and down, right and left, etc.). In contrast, use of a nozzle (or combination of two nozzles in series) that produces only a cylindrical, or even a single planar spray pattern, may not efficiently clean a large surface depending on the orientation of the nozzles and the cyclic motion of the nozzles. For example, an output nozzle (or pair of nozzles) that provides only a cylindrical flow path projects a spray geometry that contacts a smaller surface area than the V-shaped spray pattern 21 from the nozzle 10 (regardless of the orientation of the nozzle 10). Similarly, a nozzle that provides a single planar spray pattern that is moved cyclically in a direction parallel to the planar spray pattern projects a spray geometry that contacts a relatively small surface area for a given spray flow rate.

Figure 8:
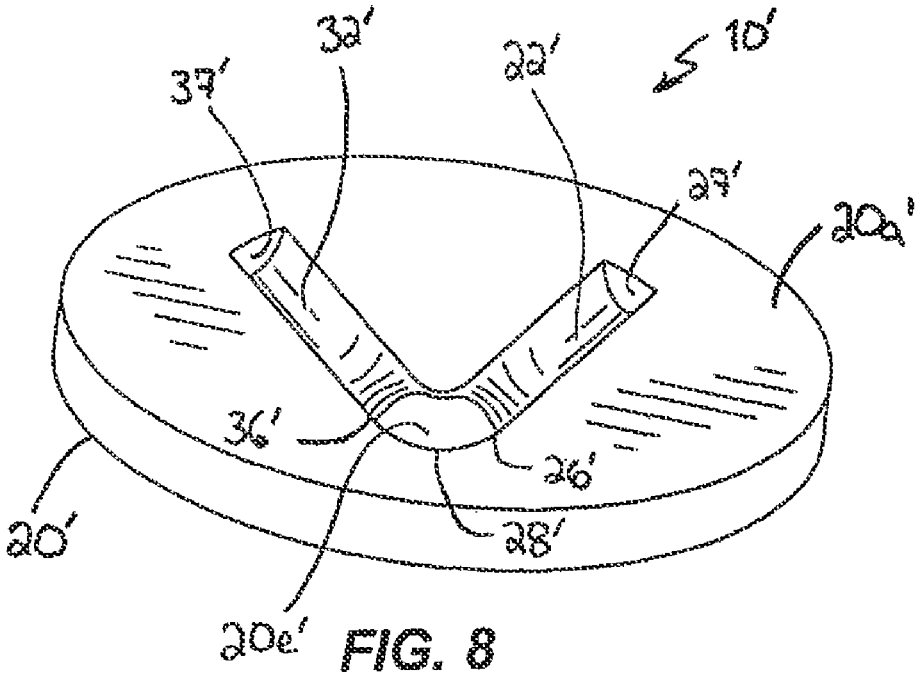
FIG. 8 is a perspective view of an inner surface of a portion of a nozzle according to another construction of the invention.
Figure 9:
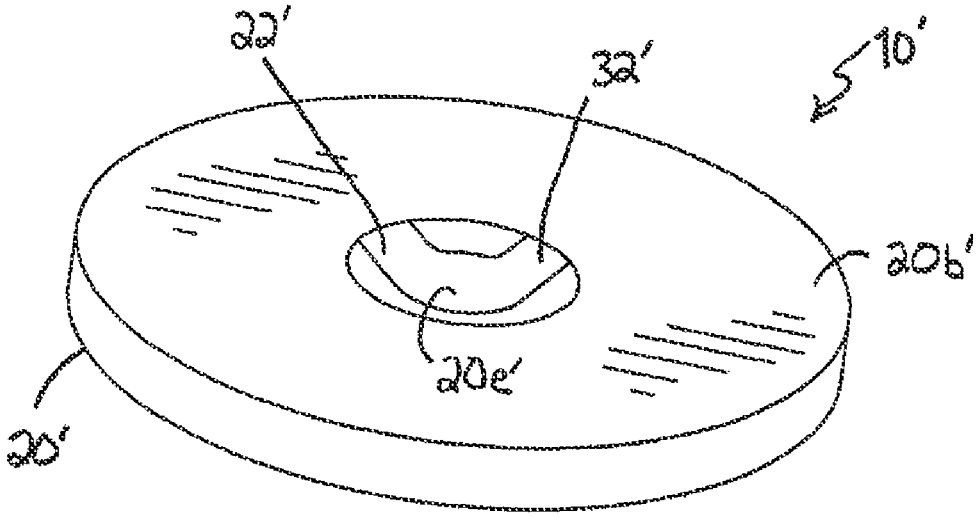
FIG. 9 is a perspective view of an outer surface of the portion of the nozzle of FIG. 8.

FIGS. 8 and 9 illustrate a nozzle 10' according to another embodiment of a portion of the nozzle 10 of FIGS. 1-7. The portion of the nozzle 10' of FIGS. 8 and 9 is similar to the nozzle 10 of FIGS. 1-7, and like components have been given like reference numbers with the addition of a prime symbol. Only some of the differences between the nozzles 10 and 10' will be discussed herein. FIGS. 8 and 9 illustrate the face 20' of the nozzle 10'. The slots 22' and 32' are formed on the inner surface 20*a*' of the face 20' as compared to the outer surface 20*b* of the nozzle 10 of FIGS. 1-7. Further, the first and second slots 22' and 32' each communicate with a single central aperture 20*e*', which allows for fluid communication from the first and second slots 22' and 32' through the face 20' and ultimately out of the nozzle 10'. The orientation of the first and second slots 22' and 32' and the central aperture 20*e*' also allows the stream of liquid extending from the nozzle 10' to form the substantially V-shaped spray pattern as discussed above with respect to the nozzle 10 of FIGS. 1-7.

Figure 10:
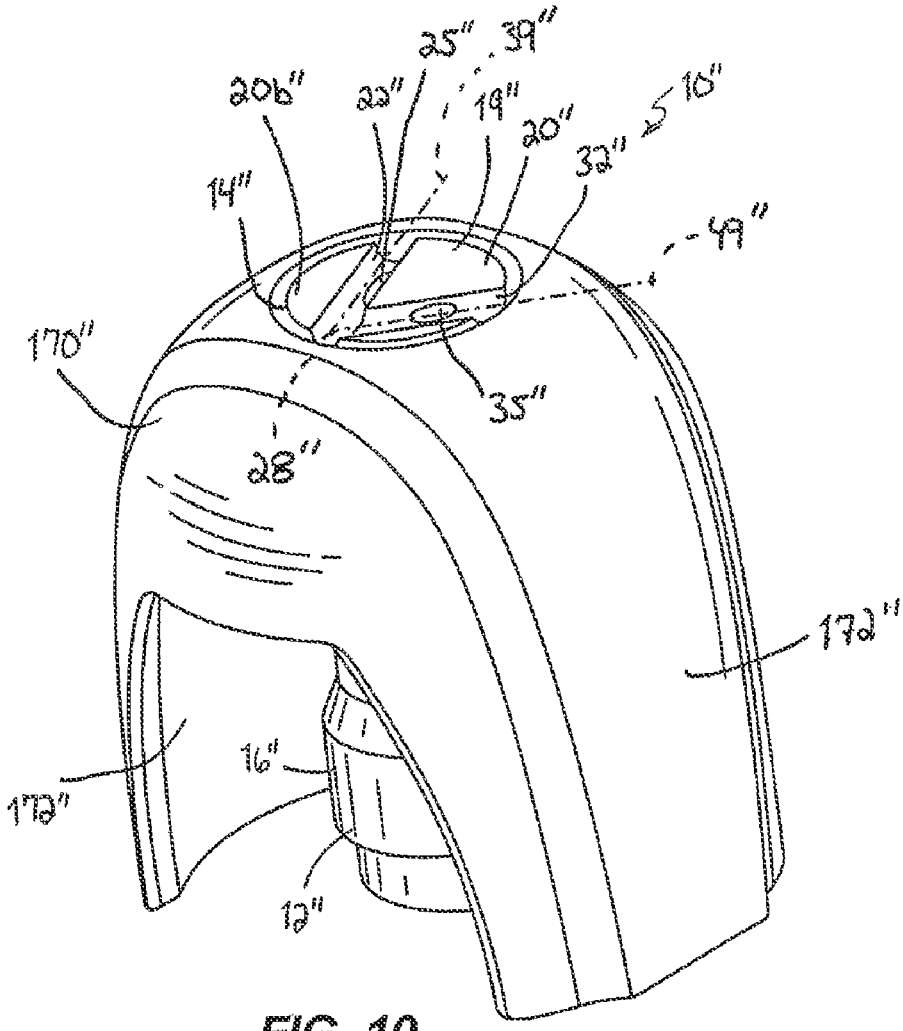
FIG. 10 is a perspective view of a nozzle according to another construction of the invention.

FIG. 10 illustrates a nozzle 10" according to another embodiment of the nozzle 10 of FIGS. 1-7. The nozzle 10" of FIG. 10 is similar to the nozzle 10 of FIGS. 1-7, and like components have been given like reference numbers with the addition of a double prime symbol. Only some of the differences between the nozzles 10 and 10" will be discussed herein. As shown in FIG. 10, the nozzle 10" includes a shroud 170" that surrounds at least a portion of the body portion 12" of the nozzle 10". The shroud 170" may include one or more fins 172" that project rearwardly from the head portion 14" of the nozzle 10" toward a rear end of the nozzle 10". The fins 172" surround at least a portion of the body portion 12" of the nozzle 10" to mechanically protect the outer surfaces of the body portion 12" from impacting a flat surface if the nozzle 10" is inadvertently dropped or otherwise impacted. Protection of the body portion 12" prevents premature failure of the nozzle 10" due to deformation of the male insertion portion, which if deformed could allow fluid leakage when connected to a female quick connect coupler. The fins 172" may additionally be sized and shaped to closely surround a sleeve of a female quick connect coupler (not shown) when the nozzle 10" is connected thereto, which would substantially prevent inadvertent retraction of the sleeve when attached to the nozzle 10" Other than the addition of the shroud 170", the nozzle 10" is constructed in the same manner as nozzle 10 discussed above, and includes two slots 22" and 32" defined in a substantially V-shaped orientation to produce a substantially V-shaped spray pattern. A nozzle with a rearwardly extending shroud is fully disclosed in U.S. Published Application 2007/0131792, filed on Dec. 14, 2005, and published on Jun. 14, 2007, the entire contents of which is fully incorporated by reference herein.

Thus, the invention provides, among other things, a nozzle for use with a pressure washer. Various features and advantages of the invention are set forth in the following claims.

What is claimed is:

1. A nozzle for use with a pressure washer having an output device to direct a fluid flow, the nozzle comprising:

a body portion that defines a longitudinal axis, the body portion configured to be fluidly coupled with the output device of the pressure washer to receive the fluid flow;

a head portion coupled to the body portion and in fluid communication with the body portion, the head portion including a face substantially perpendicular to the longitudinal axis of the body portion;

an elongated first slot disposed upon the face of the head portion;

an elongated second slot disposed upon the face of the head portion and in a nonparallel orientation with respect to the first slot; and a fluid outlet aperture extends through the face and is at least partially located within at least one of the first and second slots to allow the fluid flow from within the body portion to exit the nozzle from the head portion, wherein the first and second slots are configured to emit a flow of fluid therethrough in a substantially V-shaped pattern.

2. The nozzle of claim 1, wherein the face comprises an outer surface and an opposite inner surface, wherein the inner surface faces the body portion, and wherein the first and second slots are disposed upon the outer surface of the face.

3. The nozzle of claim 1, wherein the face comprises an outer surface and an opposite inner surface, wherein the inner surface faces the body portion, and wherein the first and second slots are disposed upon the inner surface of the face.

4. The nozzle of claim 1, wherein each of the first and second slots includes first and second ends, wherein the first end of the first slot is disposed proximate the first end of the second slot.

5. The nozzle of claim 1, wherein each of the first and second slots includes first and second ends, wherein the first ends of each of the first and second slots are disposed upon the face in an intersecting manner.

6. The nozzle of claim 1, wherein each of the first and second slots extends along a substantially straight line.

7. The nozzle of claim 6, wherein each of the first and second slots defines a longitudinal axis, the longitudinal axes of the first and second slots define an included angle therebetween, wherein the included angle is between about 30 degrees and about 120 degrees.

8. The nozzle of claim 7, wherein the included angle is between about 45 degrees and about 75 degrees.

9. The nozzle of claim 1, wherein the fluid outlet aperture is a first fluid outlet aperture disposed within the first slot, the nozzle further comprising a second fluid outlet aperture disposed within the second slot.

10. The nozzle of claim 9, wherein the first and second slots each include a first end and a second end, wherein the first ends of the first and second slots intersect such that the first and second slots define a continuous slot.

11. The nozzle of claim 10, wherein the first and second slots each comprise a straight portion at an intersection of the first and second slots such that the first and second slots are configured in a substantially V-shaped pattern upon the face.

12. The nozzle of claim 9, wherein the first and second slots are each configured to emit a planar flow of fluid therefrom.

13. The nozzle of claim 9, wherein each of the first and second fluid outlet apertures defines a length, wherein each of the first and second slots defines a length, wherein the length of the first fluid outlet aperture is less than the length of the first slot, and wherein the length of the second fluid outlet aperture is less than the length of the second slot.

14. The nozzle of claim 9, wherein the first fluid outlet aperture is configured such that a portion of the fluid flow through the first fluid outlet aperture travels through at least a portion of the first elongated slot prior to exiting the face, and wherein the second fluid outlet aperture is configured such that a portion of the fluid flow through the second fluid outlet aperture travels through at least a portion of the second elongated slot prior to exiting the face.

15. A pressure washer system comprising:

an inlet connection configured to receive a flow of fluid from a fluid supply;

a pump having an outlet, the pump configured to receive the flow of fluid and provide an output flow through the outlet;

an output device in fluid communication with the outlet of the pump to receive the output flow;

a nozzle coupled to the output device to receive the output flow, the nozzle including first and second elongated slots that together emit a spray pattern having first and second substantially planar nonparallel fluid flows, wherein the first and second slots each include a first end portion and a second end portion, wherein the first end portion of the first slot is disposed proximate the first end portion of the second slot such that the nozzle is configured to emit the spray pattern as a substantially V-shaped fluid flow pattern.

16. The pressure washer of claim 15, wherein the first end portion of the first slot intersects the first end portion of the second slot.

17. The pressure washer of claim 15, wherein the nozzle is a first nozzle, the pressure washer further comprising a second nozzle connected to the output device, wherein the output device and the second nozzle are each configured to receive a second distinct flow of fluid from the inlet connection, the second nozzle is configured to emit the second flow of fluid from the second nozzle in a second spray pattern.

18. The pressure washer of claim 17, wherein the first and second nozzles are aligned upon the output device such that the second spray pattern emitted from the second nozzle is disposed at least partially between the substantially V-shaped spray pattern emitted from the first nozzle.

19. A nozzle for use with a pressure washer having an output device to direct a fluid flow, the nozzle comprising:

a body portion that defines a longitudinal axis, the body portion configured to be fluidly coupled with the output device of the pressure washer to receive the fluid flow;

a head portion coupled to the body portion and in fluid communication with the body portion, the head portion including a face lying in a plane;

an elongated first slot disposed upon the face and extending in a first direction in the plane;

an elongated second slot disposed upon the face and extending in a second direction in the plane, the second direction being non-parallel with the first direction; and a fluid outlet aperture that extends through the face and is at least partially located within at least one of the first and second slots to allow the fluid flow from within the body portion to exit the nozzle from the head portion.

20. The nozzle of claim 19, wherein each of the first and second slots defines a longitudinal axis, the longitudinal axes of the first and second slots are non-parallel.

21. The nozzle of claim 20, wherein each of the first and second slots defines a longitudinal axis, the longitudinal axes of the first and second slots define an included angle therebetween, wherein the included angle is between about 30 degrees and about 120 degrees.

22. The nozzle of claim 19, wherein the first and second slots are configured to emit a flow of fluid therethrough in a substantially V-shaped pattern.

23. The nozzle of claim 19, wherein the first and second slots each include a first end and a second end, wherein the first ends of the first and second slots intersect such that the first and second slots define a continuous slot.

24. The nozzle of claim 19, wherein the first and second slots do not extend through the head such that fluid flow from within the body through the first and second slots is inhibited.

25. A nozzle for use with a pressure washer operable to clean a surface with a fluid flow, the pressure washer having an output device to direct the fluid flow, the nozzle comprising:

a body portion that defines a longitudinal axis, the body portion configured to be fluidly coupled with the output device of the pressure washer to receive the fluid flow;

a head portion coupled to the body portion and in fluid communication with the body portion, the head portion including a face;

an elongated first slot disposed upon the face of the head portion;

an elongated second slot disposed upon the face of the head portion; and a fluid outlet aperture that extends through the face and is at least partially located within at least one of the first and second slots to allow the fluid flow from within the body portion to exit the nozzle from the head portion, and wherein the first and second slots are configured on the face to emit a flow of fluid therethrough in a substantially V-shaped pattern.

26. The nozzle of claim 25, wherein the first and second slots are configured on the face such that the flow of fluid contacts the surface in one of a substantially V-shaped pattern and an X-shaped pattern.

27. The nozzle of claim 25, wherein each of the first and second slots defines a longitudinal axis, the longitudinal axes of the first and second slots are non-parallel.

28. The nozzle of claim 27, wherein each of the first and second slots defines a longitudinal axis, the longitudinal axes of the first and second slots define an included angle therebetween, wherein the included angle is between about 30 degrees and about 120 degrees.

* * * * *